US005079037A

United States Patent [19]

Morrison et al.

[11] Patent Number: 5,079,037

[45] Date of Patent: Jan. 7, 1992

[54] RESISTIVE FILMS COMPRISING RESISTIVE SHORT FIBERS IN INSULATING FILM FORMING BINDER

[75] Inventors: Ian D. Morrison, Webster, N.Y.; Arthur J. Epstein, Bexley, Ohio

[73] Assignee: Xerox Corporation, Stamford, Conn.

[21] Appl. No.: 458,426

[22] Filed: Dec. 28, 1989

[51] Int. Cl.[5] ..... B05D 7/00

[52] U.S. Cl. ..... 427/212; 427/74; 427/388.5; 428/297; 428/903; 428/411.1

[58] Field of Search ..... 427/212, 80, 74, 393.5, 427/388.5; 428/903, 297, 290, 411.1

[56] References Cited

U.S. PATENT DOCUMENTS

| | | | |
|---|---|---|---|
| 2,879,395 | 3/1959 | Walkup | 250/325 |
| 3,406,126 | 10/1968 | Litant | 252/511 |
| 3,624,392 | 11/1971 | Kurahashi et al. | 250/326 |
| 3,656,949 | 4/1972 | Honjo et al. | 427/74 |
| 4,110,024 | 8/1978 | Gundlach | 355/276 |
| 4,153,836 | 5/1979 | Simm | 250/325 |
| 4,491,536 | 1/1985 | Tomoda et al. | 252/511 |
| 4,569,786 | 2/1986 | Deguchi | 252/503 |
| 4,600,602 | 7/1986 | Martin et al. | 427/393.5 |
| 4,725,490 | 2/1988 | Goldberg | 252/62.54 |
| 4,781,971 | 11/1988 | Marikar et al. | 427/343 |
| 4,788,104 | 11/1988 | Adriaensen et al. | 428/288 |
| 4,795,592 | 1/1989 | Lander et al. | 252/511 |
| 4,810,419 | 3/1989 | Kunimoto et al. | 252/511 |
| 4,814,546 | 3/1989 | Whitney et al. | 156/51 |
| 4,999,240 | 3/1991 | Brotz | 428/288 |
| 5,023,127 | 6/1991 | Bachot | 428/139 |

FOREIGN PATENT DOCUMENTS 0274895 7/1988 European Pat. Off. .

OTHER PUBLICATIONS

Xerox Disclosure Journal, vol. 12, No. 2, Mar./Apr. 1987, pp. 81-82.

Lai et al., "Polymers in Electronics", *Solid State Technology*, Dec. 1984, pp. 149-154.

*Primary Examiner*—Michael Lusignan
*Assistant Examiner*—Diana Dudash
*Attorney, Agent, or Firm*—Oliff & Berridge

[57] ABSTRACT

An insulating host polymer is heavily loaded with resistive short fibers to form resistive films in the resistance range of $10^2$ to $10^8$ ohms/square having thicknesses in the range of 1.0 micron to 500 microns. The particular choice of resistive short fibers and film forming binder provides specific systems of needed resistivity and mechanical properties. Fibers are chosen having a bulk resistivity lower than a required resistivity of the resulting film and are loaded in an amount above a percolation threshold of the fibers in the film. Fine tuning of the resistivity is made by adjusting the amount of fibers in the film.

20 Claims, No Drawings

RESISTIVE FILMS COMPRISING RESISTIVE SHORT FIBERS IN INSULATING FILM FORMING BINDER

BACKGROUND OF THE INVENTION

This invention relates to resistive films and processes for preparing and using the resistive films, particularly in the field of electrophotography.

In electrophotography, an electrophotographic plate containing a photoconductive insulating layer on a conductive layer is imaged by first uniformly electrostatically charging its surface. The plate is then exposed to a pattern of activating electromagnetic radiation such as light which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reversible photoconductive insulating layers.

In electophotography, there is a common need for inexpensive easily fabricated resistive films in the resistance range of about $10^2$ to $10^8$ ohms/square and thicknesses in the range of about 1.0 micron to 500 microns. Resistive films are generally made by dispersing conductive materials in an insulating matrix. However, it is difficult accurately and precisely to control the resistance of films within this range due to sudden changes in resistance at the percolation threshold of the conducting components of the films.

There is a need for resistive films which can be prepared with resistances varied over a substantial range. Fabrication of such films has been problematic. Typically, the resistance of the films is changed by varying the quantity of conductive material dispersed in a binder. A greater resistance is achieved by lower loadings of the conductive material. However, very small decreases in loading of conductive materials at the percolation threshold cause dramatic increases in resistance. These increases in resistance are most dramatically seen when the conductive materials are particles. Light loadings of conductive particles in insulating host polymers have been attempted to avoid the dramatic increase in resistance at the percolation threshold. However, this leads to inhomogeneity and difficulty in controlling material parameters. To reduce this effect, various less conductive materials have been used at high loadings, for example, various metal containing particles and various carbon black particles. However, high loadings of particles in a film make the film brittle.

An example of the need for resistive films can be found in corona charging devices, such as scorotrons. The flat scorotron is a current charging device based on a concept by R. W. Gundlach et al, European Patent Publication No. 0-274-895, published July 20, 1988. The device comprises a set of thin conductive lines deposited on a substrate and is used to replace the free-standing corona wire in a typical electrophotographic device. A flat scorotron has a number of advantages over other corona charging devices, such as being easier to clean, less likely to break because of paper misfeed or cleaning, and inexpensive to produce. However, the device suffers from a number of problems. Any differences in the microstructure of the pins cause each pin to form a corona at a slightly different voltage. Once a corona forms at the end of a pin, the voltage drops because the corona sustaining voltage is less than the corona onset voltage. The drop in voltage prevents other pins from, forming a corona. This self-limiting behavior can be overcome by including current limiting resistances between each pin and the bus bar. However, it is difficult to control the resistances because the required resistivity for such devices is at the edge of the percolation threshold for most materials. Any small, local changes in composition result in large changes in resistivities making it difficult to obtain a controlled, uniform resistivity.

Another example of the need for resistive films can be found in document sensing devices in xerographic copying machines. As a document or paper passes between an electrical contacting brush and a resistive film, the resistance of the circuit is changed. A sensing circuit will produce a signal indicative of the presence and position of the paper and the document path may be corrected. See H. Rommelmann et al, Xerox Disclosure Journal 12(2) 81-2 (1987).

Another example of the need for resistive films can be found in simple voltage sensors for electrostatically charged surfaces. A high voltage sensor fabricated with a resistive film bleeds only a small quantity of charge from a surface leaving the charge density nearly unchanged.

U.S. Pat. No. 4,491,536 to Tomoda et al discloses a composition comprising a fluoroelastomer and carbon fibers having a length of 0.1 to 5 millimeters. A volume "resistivity" of $10^{-1}$ to $10^{13}$ ohm-cm can be achieved with the composition. However, a slight increase in the loading of carbon fiber may produce a dramatic increase in volume resistivity of as much as 12 orders of magnitude. Thus, slight inconsistencies in the composition may lead to large changes in resistivity, especially in compositions having about 15–25% parts fibers.

Fibers have been used to achieve conductive compositions. For example, U.S. Pat. No. 4,569,786 to Deguchi discloses an electrically conductive composition comprising metallic and carbon fibers dispersed in a thermoplastic resin. The metallic and carbon fibers have a length of from 0.5 to 10 mm and are provided to impart conductivity to the composition. U.S. Pat. No. 3,406,126 to Litant discloses a conductive synthetic resin composition containing carbon filaments having a length of ¼ to ¾ inch in length. U.S. Pat. No. 4,810,419 to Kunimoto et al discloses a shaped electroconductive aromatic imide polymer article comprising an aromatic imide polymer matrix and 10% to 40% by weight of 0.05 to 3.0 mm long carbon fibers.

In these and other references, the emphasis is primarily on achieving highly conductive compositions. The resistivity of these compositions is difficult to control accurately and precisely. If fibers are used in the composition, the resistivity of the fibers may vary from batch to batch. Further, since the fibers are relatively long, the fibers tend to break. Breaks in the fibers result in fewer conductive pathways, leading to problems such as degraded performance of the composition.

There continues to be a need for materials having a proper resistivity which can be selected accurately while avoiding inhomogeneities in resistivity within the films formed from the materials.

SUMMARY OF THE INVENTION

It is an object of the invention to provide resistive films which can have their resistivities accurately and reliably selected for a particular application.

It is an object of the invention to provide films which have uniform and predictable resistivities.

It is a further object of the invention to provide resistive films which can have their mechanical properties selected for a particular application.

It is also an object of the invention to provide a process for fabricating resistive films.

These and other objects of the invention are achieved by heavy loading of an insulating film forming binder with resistive short fibers having a selected resistivity. One can select specific systems for the needed resistivity based on the resistivity of the short fibers. Furthermore, mechanical properties can be selected by choice of the film forming binder.

DETAILED DESCRIPTION OF PREFERRED EMBODIMENTS

Resistive films of the present invention are fabricated through heavy loading of resistive short fibers in an insulating film forming binder. Short fibers of the invention have intrinsic resistivities differing by many orders of magnitude. Selected short fibers having a given intrinsic resistivity are mixed with an insulating binder polymer in solution. When a film is formed and dried from such a dispersion a well-connected array of fibers extends throughout the polymer film. Further, the fibers tend to reinforce the polymer binder to produce a more durable film.

Alternatively, short fibers having an intrinsic resistivity which is selectable over many orders of magnitude are mixed with an insulating prepolymer such as monomers, oligomers, or mixtures of monomers and oligomers, and with polymerization initiators such that the fibers and prepolymer have approximately equal volumes. When a film is formed and cured from such a mixture, a well-connected array of fibers extends throughout the polymer film.

The bulk resistivity of a material is an intrinsic property of the material and can be determined from a sample of uniform cross-section. The bulk resistivity is the resistance of such a sample times the cross-sectional area divided by the length of the sample. The bulk resistivity can vary somewhat with the applied voltage.

The surface or sheet resistivity (frequently expressed as ohms per square) is not an intrinsic property of a material but depends upon the thickness of the film and is the bulk resistivity divided by the thickness of the film. The surface resistivity of a film can be measured even without knowing the film thickness as the resistance between two parallel contacts placed on the film the same length as the gap between them. This resistivity is reported as ohms per square. Fiber material is chosen which has a bulk resistivity slightly lower than the desired bulk resistivity of the resulting film.

In general, the short fibers are selected based upon the required resistivity of the film. High volume fractions or loadings of the fiber are used so that the number of conductive pathways is always cell above the percolation threshold, thereby avoiding extreme variations in resistivity. The percolation threshold of a composition is a volume concentration of dispersed phase below which there is so little particle to particle or fiber to fiber contact that the connected regions are small. At higher concentrations than the percolation threshold, the connected regions are large enough to traverse the volume of the film.

The percolation threshold is an idealized concept and practically is within a range of a few volume per cent. For any particular fiber resistivity at a loading above the percolation threshold, the resistivity of the coated film can be varied over about one order of magnitude by changing the volume fraction of the fiber in the layer. This variation in volume loading enables easy fine-tuning of resistivity and compensation for any possible variations in bulk resistivity from batch to batch of fiber.

According to the present invention, the resistivity varies approximately proportionately to the bulk resistivity of the individual fibers and the volume fraction of the fibers in the film. These two parameters can be selected independently. For any particular fiber resistivity, the resistivity of the coated film can be varied over roughly an order of magnitude by changing the volume fraction of the fiber. Thus, the bulk resistivity of the fibers is preferably chosen to be approximately three orders of magnitude or less lower than the bulk resistivity desired in the film. When the fibers are mixed with the insulating film-forming binder in an amount above the percolation threshold, the resistivity of the resulting film changes in an approximately linear manner, especially at loadings significantly exceeding the percolation threshold. Fine tuning of the final resistivity may be accurately controlled on the basis of this approximately linear change in resistivity.

Fibers which may be utilized in the present invention include fibers having a bulk resistivity between about $10^{-2}$ ohms-cm to about $10^{4}$ ohms-cm. These resistivities permit preparation of films having electrical sheet resistivities between about $10^{2}$ to $10^{8}$ ohms/square.

Fibers which may, be used in the present invention include, for example, tetracyanoquinodimethane (TCNQ) salts, phthalocyanines, polycarbazoles, polyphenothiazines, polyimides such as pyrolyzed polyacrylonitrile, and fibers made from doping of polymers such as polyacetylene, poly-p-phenylene, polypyrrole, polyalumino phthalocyanine fluoride, polyphthalocyanine siloxane, polyphenylene sulfide, and polysilylenes doped with arsenic pentafluoride, iodine, perchlorates, and boron tetrafluorides. See, for example, J. H. Lai, et al, Solid State Technology, December 1984, pp. 149–154.

According to the present invention, fibers are dispersed in an inert polymer binder at a volume loading of fibers sufficiently above the percolation threshold so that the resistivity of the film is low. The fibers are preferably present in an amount of about 15 volume percent to about 85 volume percent based on volume of the binder, and more preferably in an amount of about 35 volume percent to about 65 volume percent.

Short fibers are used to enable the coating of uniform thin films as thin as about one micron. The fibers of the present invention preferably have a submicroscopic fiber length (less than a micron). The fibers may have a length of about 0.05 micron to about 0.5 micron. Preferably, the fibers have a length of about 0.1 micron to about 0.5 micron. The fiber lengths should be less than the coated film thickness. To obtain fibers having a submicroscopic length, fiber material may be subjected to grinding. Pre-cut fibers, for example, one centimeter in length, may be ground in solution. Grinding techniques include, for example, ball milling with steel shot, high sheer mixing, attrition, wrist shakers with steel shot and paint shakers with steel shot. In these techniques, fibers are ground in pure solvents. Known solvents may be used: for example, pyridine, cyclohexanone, toluene, acetone, DMSO, acetonitrile, p-dioxane, methylene chloride, THF, methanol, dimethylamide, 2-methylbutane, 1,1,1-trichloroethane, propanol, diethyl amine, chloroform, methyl ethyl ketone (MEK), $CCl_4$, water, and mixtures thereof such as MEK/-toluene/water and MEK/toluene.

Known insulating film forming binders may be used in the present invention for dispersing the fibers. The particular binder chosen is not critical, provided the binder is film forming, soluble in a suitable solvent, and capable of dispersing the fibers uniformly in the resulting film. The binder is preferably also water insoluble for humidity stability. The choice of film forming binder may depend upon the desired mechanical properties of the film. Examples of preferred film forming binders include polyurethanes, polyasters, polytetrafluoroethylene and other fluorocarbon polymers, polycarbonates, poly(methylmethacrylate) (PMMA), phenoxy resins, for example, from Union Carbide Corp., polyarylethers, polyarylsulfones, polysulfones, polybutadiene, polyether sulfones, polyethylene, polypropylene, polyimides, polymethylpentene, polyphenylene sulfides, polystyrene and acrylonitrile copolymers, polyvinyl chloride and polyvinyl acetate and copolymers thereof, poly(vinyl butyral) (PVB), silicones, acrylic polymers and copolymers, alkyds, epoxies, nylon and other polyimides, phenol, cellulose, amines, phenylene oxides, and the like.

The resistive films of the invention may be applied having a thickness of about 0.1 micron to about 500 microns. The particular resistivity desired per square may be obtained by choosing a particular film thickness.

The invention will be further described in connection with the following non-limitative examples. The invention is not intended to be limited to the particular materials, process parameters and the like enumerated therein.

EXAMPLE 1

Two grams of cut (nominally 6 mm in length) polyacrylonitrile fibers are shaken in 20 ml of solvent with 20 grams of steel shot for 40 minutes in each of 18 bottles. The fiber used is a partially pyrrolyzed polyacrylonitrile, CELECT 675, batch no. XRX 3/784/13 from Celanese, with a resistivity of $1.6\times10^5$ ohm-cm at 3K volts and a resistivity of $8.0\times10^4$ ohm-cm at 6K volts. To each of six of the bottles of milled fiber is added 2.0 gms of one of the following polymers from Scientific Polymer Products, Ontario, N.Y.: styrene acrylonitrile, polycarbonate, phenoxy resin, polyvinyl butyral and polymethylmethacrylate. The styrene acrylonitrile is added to methylene chloride; the polycarbaonte is added to methylene chloride; the phenoxy resin is added to a 12/6/2 by volume mixture of MEK/-toluene/water; the polyvinylbutyral is added to both propanol and THF; and the polymethylmethacrylate is added to chloroform. A second set of six samples is made in the same manner as the first set, except that only 1.0 gm of the polymers is used. A third set of six samples is made in the same manner as the first set, except that 3.0 gms of the polymers are used. The set of eighteen samples gives five different polymer/fiber mixes at three different ratios of polymer to fiber. One of the polymers is prepared in two different solvents. In general, the fibers form bimodal distributions of lengths, one mode with an aspect ratio of about 10–50:1 and a second mode with an aspect ratio of about 2–3:1.

Each coating is coated in a thickness of 30–100 microns on a piece of Mylar with a drawbar coater and dried in a vacuum oven at a moderate (40°–60° C.) temperature. A piece of the dried film is cut approximately 0.5 cm by 2.0 cm and placed against the probes of a 4 point probe device. The results are given in Table 1. The resistivity cf the coating is measured by a 4-probe technique. These results show that coatings having resistivities within the desired range can be obtained.

TABLE 1

| Binder | Resistivity (ohm-cm) 25% Fiber | 50% Fiber | 75% Fiber |
|---|---|---|---|
| Styrene-Acrylonitrile | $5.8\times10^8$ | $2.0\times10^5$ | $7.6\times10^4$ |
| Polycarbonate | $5.7\times10^7$ | $3.5\times10^5$ | — |
| Phenoxy resin | — | $5.1\times10^7$ | — |
| Polyvinyl butyral (propanol) | $8.1\times10^6$ | $2.5\times10^4$ | $7.6\times10^6$ |
| Polyvinyl butyral (THF) | $2.1\times10^5$ | $6.6\times10^4$ | $8.9\times10^4$ |
| Poly (methyl-methacrylate) | $5.6\times10^5$ | $7.1\times10^4$ | $2.1\times10^4$ |

Goal: To obtain a resistivity of about $10^4$ ohm-cm
Films: 30–100 microns thick
Fiber resistivity: about $10^3$ ohm-cm (at 100 volts)

EXAMPLE 2

To verify the results in Table 1, the procedure of Example 1 was repeated with 25, 38, 59, 62 and 75 weight percent fiber in the binder. The results are given in Table 2. These results demonstrate that coatings can be obtained having the desired resistivity.

TABLE 2

| Binder | Resistivity (ohm-cm) 25% Fiber | 38% Fiber | 50% Fiber | 62% Fiber | 75% Fiber |
|---|---|---|---|---|---|
| Styrene-Acrylonitrile | — | $1.9\times10^6$ | $4.7\times10^5$ | $1.4\times10^5$ | $7.7\times10^4$ |
| PVB (propanol) | $2.8\times10^5$ | $3.8\times10^5$ | $2.8\times10^5$ | $8.8\times10^5$ | $1.5\times10^5$ |
| PVB (THF) | — | $1.2\times10^7$ | $7.3\times10^5$ | $1.1\times10^7$ | $2.0\times10^6$ |
| Poly (methyl-methacrylate) | $2.3\times10^8$ | $4.6\times10^5$ | $6.6\times10^4$ | $3.6\times10^4$ | $2.2\times10^4$ |

Goal: To obtain a resistivity of about $10^4$ ohm-cm

These results vary somewhat from the results of Table 1 due to variations in film thickness.

EXAMPLE 3

The dispersions obtained in Example 1 were diluted with solvent until the coated dried thicknesses were between about 10 and 25 microns. The results shown in Table 3 demonstrate that coatings having the desired resistivity can be obtained.

TABLE 3

| Binder | Resistivity (ohm-cm) 50% Fiber | 62% Fiber | 75% Fiber |
|---|---|---|---|
| Styrene-Acrylonitrile | $3.6 \times 10^5$ | $6.4 \times 10^4$ | $4.0 \times 10^4$ |
| PVB | $1.0 \times 10^7$ | $3.4 \times 10^6$ | $7.6 \times 10^5$ |
| PMMA | $3.6 \times 10^5$ | $7.1 \times 10^4$ | $7.0 \times 10^5$ |
| Goal: To obtain a resistivity of about $10^4$ ohm-cm | | | |

These results vary from the results shown in Tables 1 and 2 due to different film thicknesses.

EXAMPLE 4

Long term electrical stability of the materials may also be tested. The procedure is to coat a wide section of a Mylar sheet with the dispersion and dry it. Sections of each coating two inches wide are cut and two parallel strips of silver paint are coated ⅜ inch apart over the sample to be tested. A power supply is used to establish 600 volts across the sample and an ammeter is used to measure the current flow. The current is measured intermittently for 50 minutes. In Table 4, the resistances (in megohms) of the layers initially and after 50 minutes are given. The results show that the samples appear to be electrically stable.

TABLE 4

| Binder | Stability of Resistive Films ⅜" × 2" layers: 600 V Weight loading (%) | R (t = 0) | R (t = 50 minutes) |
|---|---|---|---|
| PVB | 62 | 22.2 | 23.6 |
| | 75 | 17.0 | 17.3 |
| Styrene-acrylonitrile | 50 | 12.4 | 12.7 |
| | 62 | 2.1 | 2.0 |
| | 75 | 3.7 | 3.7 |
| PMMA | 50 | 25.5 | 25.8 |
| | 62 | 13.3 | 12.7 |
| | 72 | 10.3 | 8.1 |

EXAMPLE 5

Approximately 21 feet of Celect 675 pyrolyzed polyacrylonitrile fibers (Celanese) are cut into one centimeter lengths and added to a four ounce jar. Twenty grams of steel shot and 20 ml of solvent, methylene chloride or chloroform are added to a paint shaker in a 12 o'clock position. The paint shaker is operated for 40 minutes. Two grams of polymer, styrene-polyacrylonitrile or PMMA, are added, and the mixture is mixed on a roller until the polymer is completely dissolved. All of the sample is placed in a spray jar and another 7 mm of solvent is added. Two flat scorotrons are constructed each with nine pins spaced 0.25 cm apart, about 0.25 cm from the bus bar. The sample is spray coated on a properly masked device to connect the bus bar to the ends of the pins and dried. The coatings are dried as before. A high voltage power supply is connected to the bus bar and the voltage increased until a corona forms around the pins. For the styrene-acrylonitrile coating, 8 of the 9 pins form stable coronas and continue to fire for an hour before the test is stopped. The resistive coating enables the simultaneous firing of the pins. For the polymethylmethacrylate coating, two of the pins were accidentally shorted and burned, but all seven remaining pins form stable coronas.

Although the invention has been described with respect to specific preferred embodiments and examples, it is not intended to be limited thereto, but rather those skilled in the art will recognize that variations and modifications can be made therein which are within the spirit of the invention and the scope of the claims.

What is claimed is:

1. An article comprising a structure having thereon a resistive film, said film comprising:

resistive fibers having lengths less than the coated film thickness dispersed in a film forming binder in an amount above a percolation threshold of the fibers;

said film having an electrical sheet resistivity of about $10^2$ to about $10^8$ ohms/square.

2. The article of claim 1, wherein said film has a thickness of about 1.0 micron to about 500 microns.

3. The article of claim 1, wherein said fibers are present in a concentration of about 15% by volume to about 85% by volume based on said film forming binder.

4. The article of claim 1, wherein said fibers are present in a concentration of about 35% by volume to about 65% by volume based on said film forming binder.

5. The article of claim 1, wherein said fibers have a length of about 0.05 micron to about 0.5 micron.

6. The article of claim 1, wherein said fibers have a length less than about 1 micron.

7. The article of claim 1, wherein said fibers have a bulk resistivity about three orders of magnitude or less lower than a bulk resistivity of the film.

8. The article of claim 1, wherein said fibers have a bulk resistivity about one order of magnitude or less lower than a bulk resistivity of the film.

9. The article of claim 1, wherein said resistive fibers are selected from pyrolyzed polyimides.

10. The article of claim 1, wherein said structure is a flat scorotron device.

11. A method of making a resistive film having a controlled and uniform resistivity, comprising the steps of:

selecting fibers having fiber lengths less than the coated film thickness and a bulk resistivity lower than a predetermined bulk resistivity of said film;

mixing said fibers with a film forming binder to form a dispersion of said fibers in said binder, the amount of said fibers being such that a percolation threshold of the fibers in the binder is exceeded; and coating said dispersion on a substrate to form said film.

12. The method of claim 11, wherein said film is coated in a thickness of about 1.0 micron to about 500 microns.

13. The method of claim 11, wherein said fibers are mixed with said film forming binder in a concentration of about 15%to about 85% by volume based on volume of said film forming

14. The method of claim 11, wherein said fibers are mixed with said film forming binder in a concentration of about 35% to about 65% by volume based on volume of said film forming

15. The method of claim 11, wherein said fibers have a length of about 0.05 micron to about 0.5 micron.

16. The method of claim 11, wherein said fibers have a length less than about 1 micron.

17. The method of claim 11, wherein said bulk resistivity of said fibers is about three orders of magnitude or less lower than said predetermined bulk resistivity.

18. The method of claim 11, wherein said bulk resistivity of said fibers is about one order of magnitude or less lower than said predetermined bulk resistivity.

19. The method of claim 11, wherein said film has an electrical sheet resistivity of about $10^2$ to about $10^8$ ohms/square.

20. A resistive film made by the method of claim 11.

* * * * *